US007377144B1

(12) United States Patent
Huang

(10) Patent No.: US 7,377,144 B1
(45) Date of Patent: May 27, 2008

(54) PROTECTIVE DEVICE FOR ELECTRONIC LOCK

(75) Inventor: Zhao-Hong Huang, Yongkang (TW)

(73) Assignee: I-Tek Metal Mfg. Co., Ltd., Tainan (TW)

( * ) Notice: Subject to any disclaimer, the term of this patent is extended or adjusted under 35 U.S.C. 154(b) by 0 days.

(21) Appl. No.: 11/623,147

(22) Filed: Jan. 15, 2007

(51) Int. Cl.
*E05B 47/00* (2006.01)

(52) U.S. Cl. ..... 70/277; 70/278.1; 70/333 A; 70/423; 70/425; 70/455; 340/5.7; 340/5.53

(58) Field of Classification Search ..... 70/333 R, 70/DIG. 56, DIG. 59, 278.1, 277, 278.7, 70/423–428, 455, 333 A, 54–56, 432; 340/5.51–5.54, 340/5.7; 382/124–127; 235/382; 109/24.1
See application file for complete search history.

(56) References Cited

U.S. PATENT DOCUMENTS

| | | | | | |
|---|---|---|---|---|---|
| 99,178 | A * | 1/1870 | Flanagin | 70/423 |
| 355,421 | A * | 1/1887 | Stoddard | 70/423 |
| 1,529,766 | A * | 3/1925 | Bina | 40/460 |
| 1,979,805 | A * | 11/1934 | Main | 70/134 |
| 3,343,384 | A * | 9/1967 | Barr | 70/159 |
| 4,031,730 | A * | 6/1977 | Kern | 70/419 |
| 4,354,367 | A * | 10/1982 | Wahl | 70/333 A |
| 4,602,150 | A * | 7/1986 | Nishikawa et al. | 235/382 |
| 4,793,165 | A * | 12/1988 | Rochman | 70/284 |
| 5,235,833 | A * | 8/1993 | Pinto | 70/471 |
| 5,337,043 | A * | 8/1994 | Gokcebay | 340/5.67 |
| 5,916,282 | A * | 6/1999 | Elm et al. | 70/423 |
| 6,865,913 | B2 * | 3/2005 | Yamagishi | 70/224 |
| 6,938,445 | B2 * | 9/2005 | Huang | 70/107 |
| 2006/0186987 | A1 * | 8/2006 | Wilkins | 340/5.53 |
| 2006/0201215 | A1 * | 9/2006 | Wolf | 70/423 |

FOREIGN PATENT DOCUMENTS

| | | | |
|---|---|---|---|
| GB | 2089420 | * | 6/1982 |

* cited by examiner

*Primary Examiner*—Lloyd A Gall
(74) *Attorney, Agent, or Firm*—Alan Kamrath; Kamrath & Associates PA

(57) ABSTRACT

A protective device for an electronic lock includes a fixing plate mounted in a casing of an electronic lock and located behind an opening of the casing. The fixing plate includes a through-hole aligned with the opening. A protective cover is mounted to the fixing plate and movable between a shielding position shielding the through-hole of the fixing plate and the opening of the casing and a revealing position not shielding the through-hole of the fixing plate and the opening of the casing. The protective cover is drivable by a motor to move between the shielding position and the revealing position. A keypad is mounted to an outer side of the casing. A motor is activated to drive the protective cover when a pin code is input through the keypad.

6 Claims, 10 Drawing Sheets

PROTECTIVE DEVICE FOR ELECTRONIC LOCK

BACKGROUND OF THE INVENTION

1. Field of the Invention

The present invention relates to a protective device and, more particularly, to a protective device for an electronic lock.

2. Description of the Related Art

Electronic locks are well known, and some of them use biological features such as fingerprints and voice patterns for identification purposes such that the users do not need to carry keys. A typical electronic lock includes a fingerprint identifying device and a casing mounted to an outer face of a door. Fingerprint(s) of one or more authorized users is(are) registered in the fingerprint identifying device housed in the casing. The casing includes a finger insertion opening and a handle. The finger insertion opening is aligned with an outer side of a fingerprint input section of the fingerprint identifying device. An authorized user may insert his or her finger through the finger insertion opening to access the fingerprint input section. The handle can be operated to open the door if the input fingerprint matches with the registered data. On the other hand, the handle cannot be operated if the input fingerprint does not match with the registered data.

Although electronic locks using fingerprints work efficiently, there is no protective device for shielding the fingerprint identifying device. Hence, dust and/or moisture easily enter the electronic locks via the finger insertion opening and might cause damage to internal parts such as the finger input section of the fingerprint identifying device. Another drawback is that a burglar may destroy the fingerprint identifying device via the finger insertion opening.

The present invention is intended to provide a protective cover for an electronic lock that mitigates and/or obviate obviates the above-mentioned problems.

SUMMARY OF THE INVENTION

In accordance with an aspect of the present invention, a protective device for an electronic lock includes a fixing plate adapted to be mounted in a casing of an electronic lock and located behind an opening of the casing. The fixing plate includes a through-hole aligned with the opening. A protective cover is mounted to the fixing plate and movable between a shielding position shielding the through-hole of the fixing plate and the opening of the casing and a revealing position not shielding the through-hole of the fixing plate and the opening of the casing. A drive mechanism includes a motor for driving the protective cover to move between the shielding position and the revealing position. A keypad is adapted to be mounted to an outer side of the casing. The motor is activated to drive the protective cover from the shielding position to the revealing position when a pin code is input through the keypad.

Preferably, the drive mechanism further includes a drive plate having a first drive portion and a second drive portion. The protective cover is movable by the first drive portion from the shielding position to the revealing position. The protective cover is movable by the second drive portion from the revealing position to the shielding position.

Preferably, the first and second drive portions are respectively on upper and lower ends of the drive plate.

Preferably, the protective cover includes upper and lower protrusions respectively on upper and lower ends thereof. The upper protrusion of the protective cover is pushable by the first drive portion of the drive plate to move the protective cover from the shielding position to the revealing position. The lower protrusion is pushable by the second drive portion of the drive plate to move the protective cover from the revealing position to the shielding position.

Preferably, the fixing plate further includes two guide rails respectively on two lateral sides thereof. The protective cover includes two wings respectively and slidably engaged with the guide rails, allowing the protective cover to slide on the fixing plate in a longitudinal direction of the fixing plate between the shielding position and the revealing position.

Preferably, the fixing plate includes two bends on the lateral sides thereof and forming the guide rails.

In accordance with another aspect of the present invention, an electronic lock includes a casing, a fingerprint identifying device mounted in the casing and having a fingerprint input section accessible through an opening of the casing, and a fixing plate mounted in the casing and located behind the opening of the casing. The fixing plate includes a through-hole aligned with the opening of the casing. A protective cover is mounted to the fixing plate and movable between a shielding position shielding the through-hole of the fixing plate and the opening of the casing and a revealing position not shielding the through-hole of the fixing plate and the opening of the casing. A drive mechanism includes a motor for driving the protective cover to move between the shielding position and the revealing position. A keypad is mounted to an outer side of the casing. The motor is activated to drive the protective cover from the shielding position to the revealing position when a pin code is inputted through the keypad.

Other objectives, advantages, and novel features of the invention will become more apparent from the following detailed description when taken in conjunction with the accompanying drawings.

DETAILED DESCRIPTION OF THE PREFERRED EMBODIMENT

Figure 1:
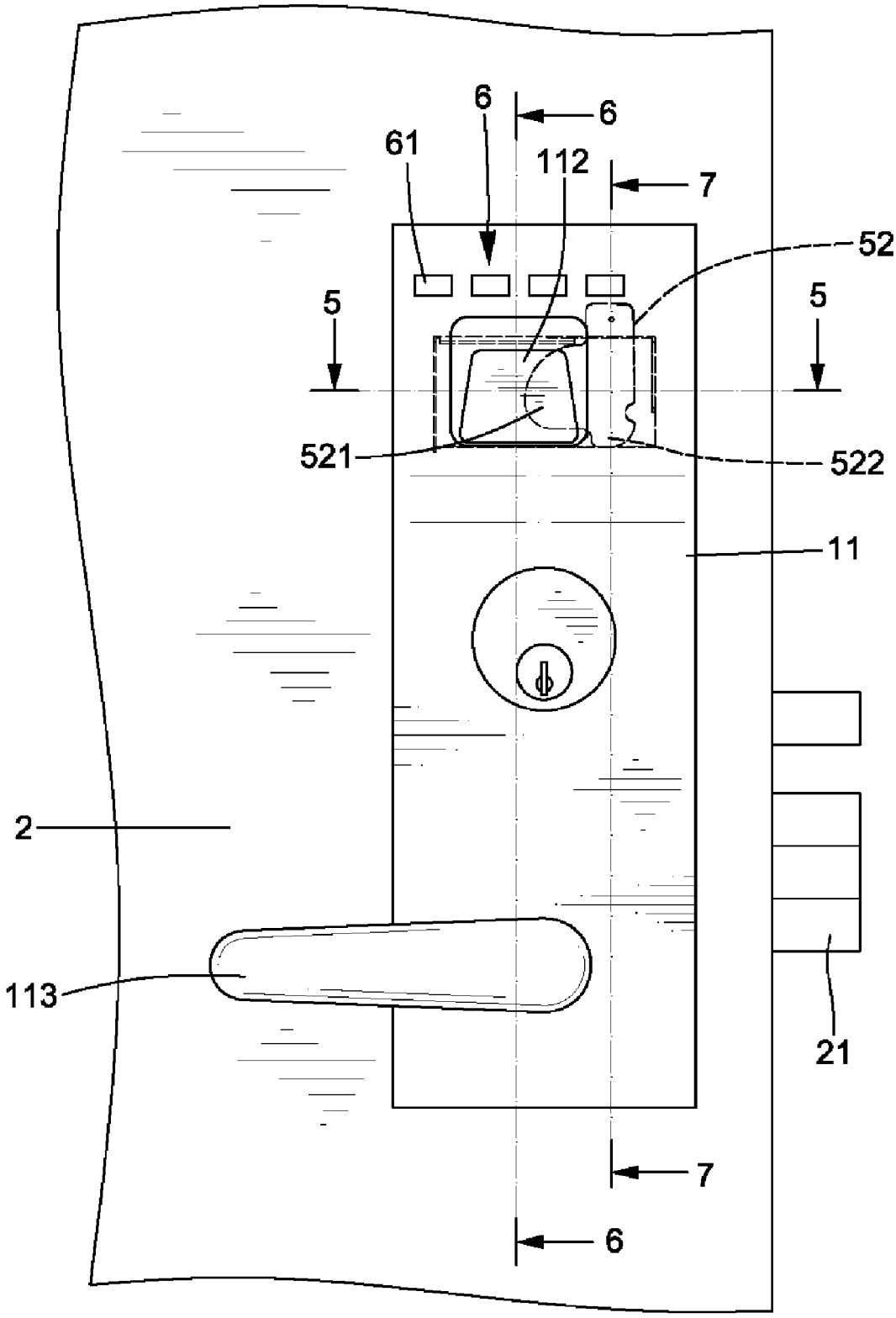
FIG. 1 is a front elevational view showing an outer face of a door and an electronic lock with a protective device in accordance with the present invention, wherein a protective cover is in a shielding position.
Figure 2:
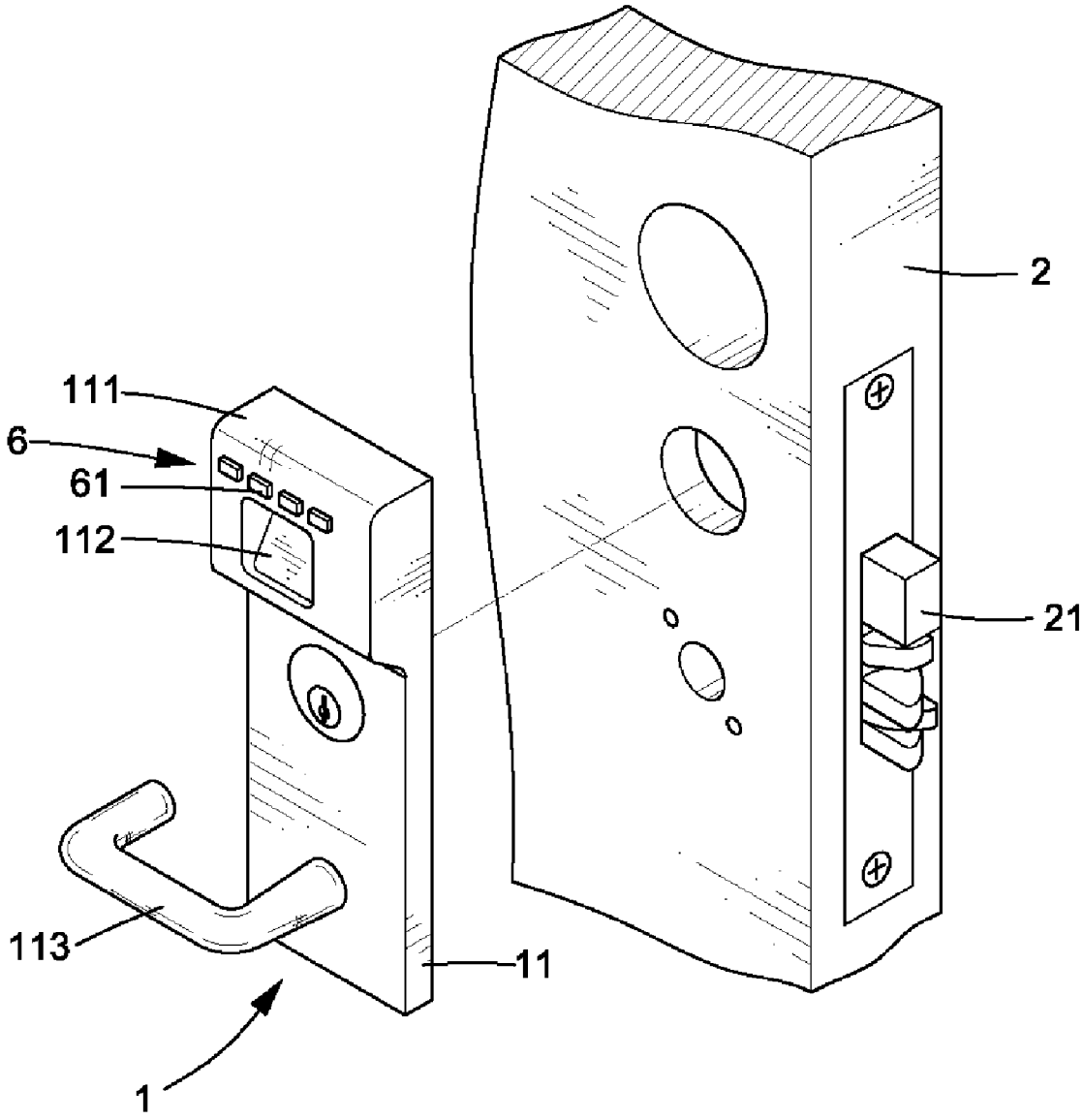
FIG. 2 is an exploded perspective view showing a portion of the door and the electronic lock with the protective device in accordance with the present invention.

Referring to FIGS. 1 and 2, an electronic lock with a protective device in accordance with the present invention is an electronic lock 1 using a biological feature such as a fingerprint to identify the user. The electronic lock 1 is mounted to an outer face of a door 2. Referring to FIGS. 1 through 4, the electronic lock 1 includes a casing 11 mounted to the outer face of the door 2 and a fingerprint identifying device 12, which are conventional. In the embodiment shown, the fingerprint identifying device 12 includes a fingerprint input section 121 (see FIG. 5) on a front end thereof. The casing 11 includes a receiving portion 111 on an upper end thereof. The receiving portion 111 includes an opening 112 through which a finger of an authorized user can be inserted to access the fingerprint identifying device 12 for inputting the fingerprint. A handle 113 is provided on the casing 111 and can be operated to retract a latch device 21 mounted to the door 2 when the input fingerprint matches with the registered data stored in the fingerprint identifying device 12. On the other hand, the handle 113 cannot be operated if the input fingerprint does not match with the registered data.

Figure 3:
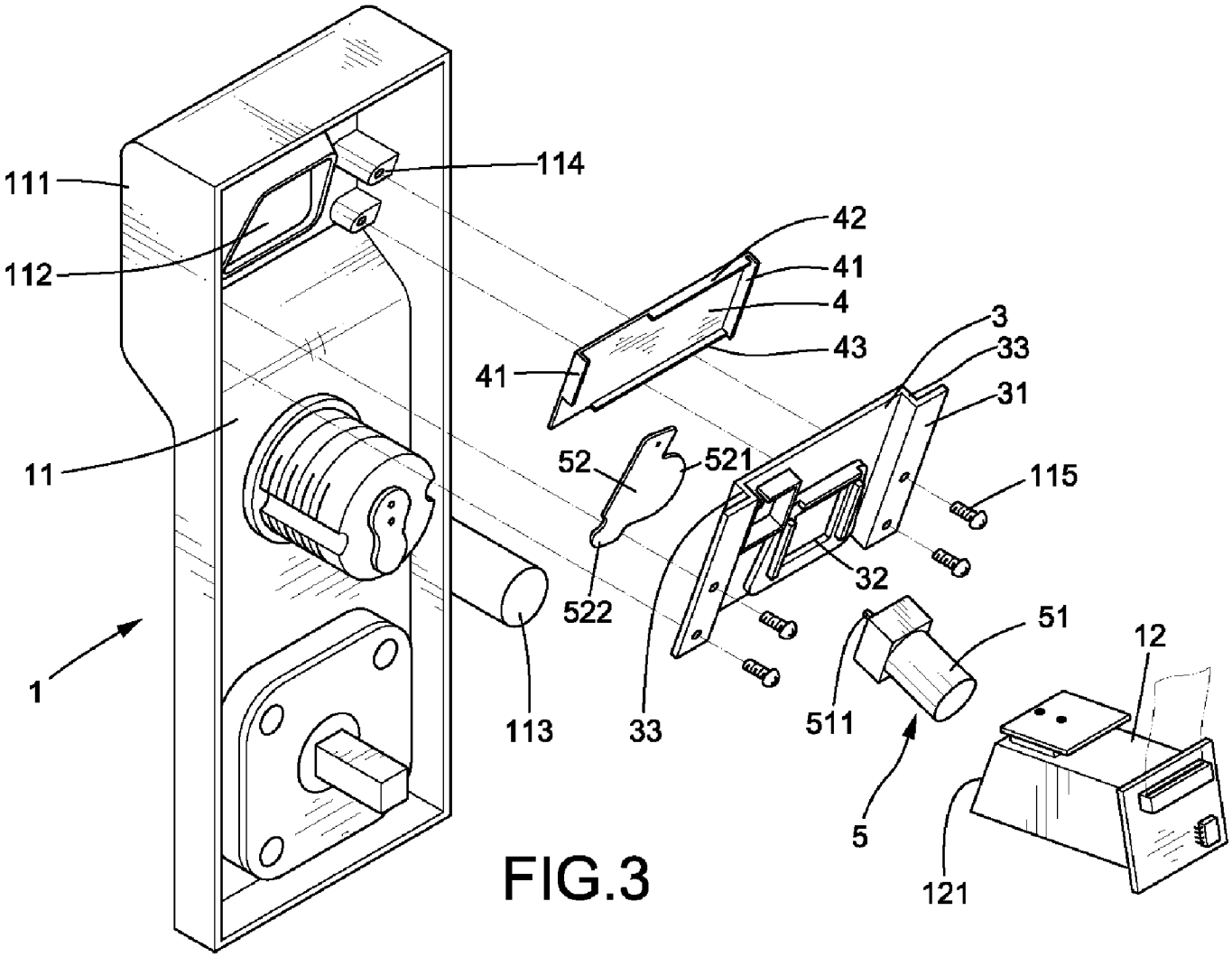
FIG. 3 is an exploded perspective view of the electronic lock in accordance with the present invention.
Figure 4:
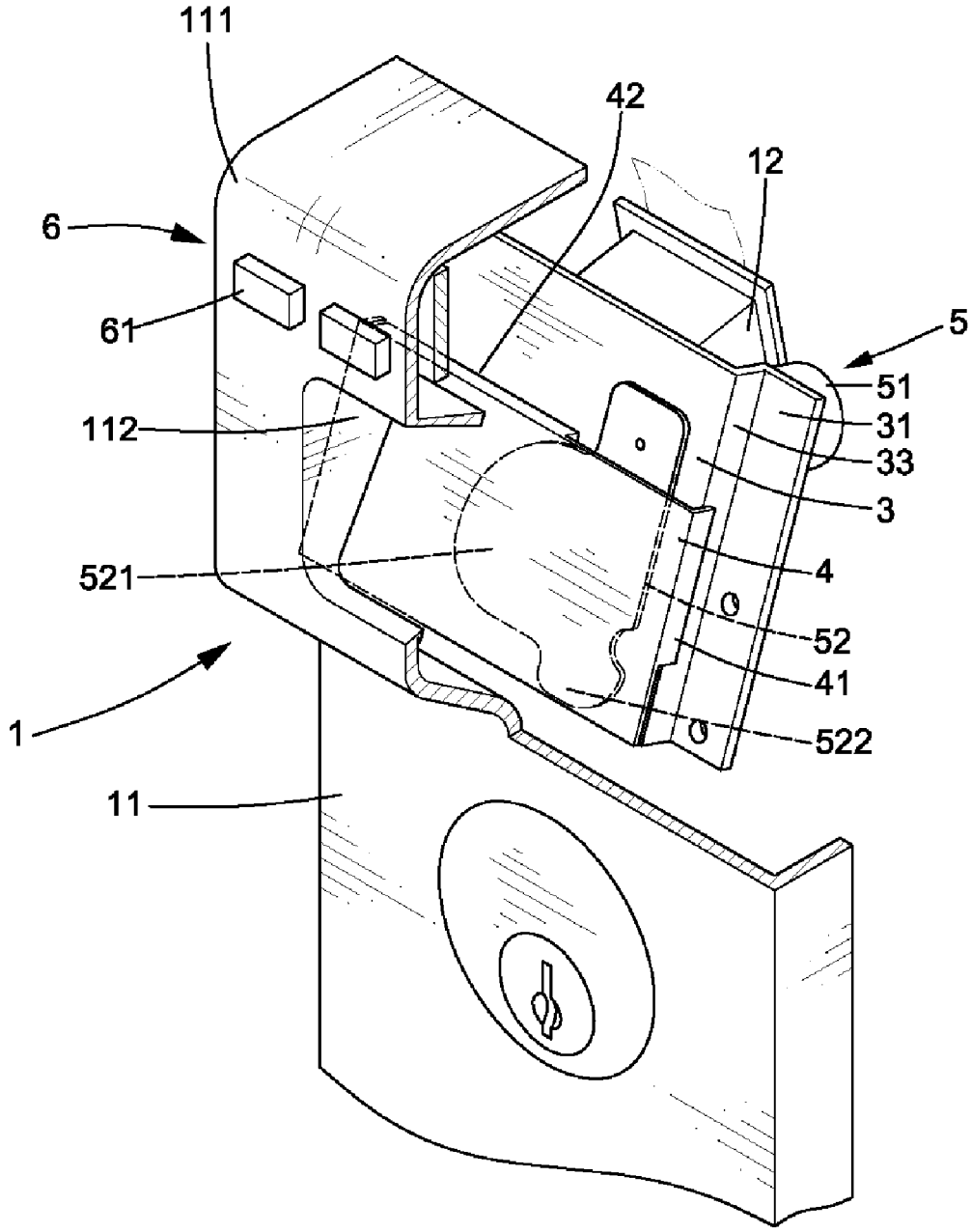
FIG. 4 is a perspective view, partially cutaway, of the electronic lock in accordance with the present invention, wherein the protective cover is in the shielding position.
Figure 5:
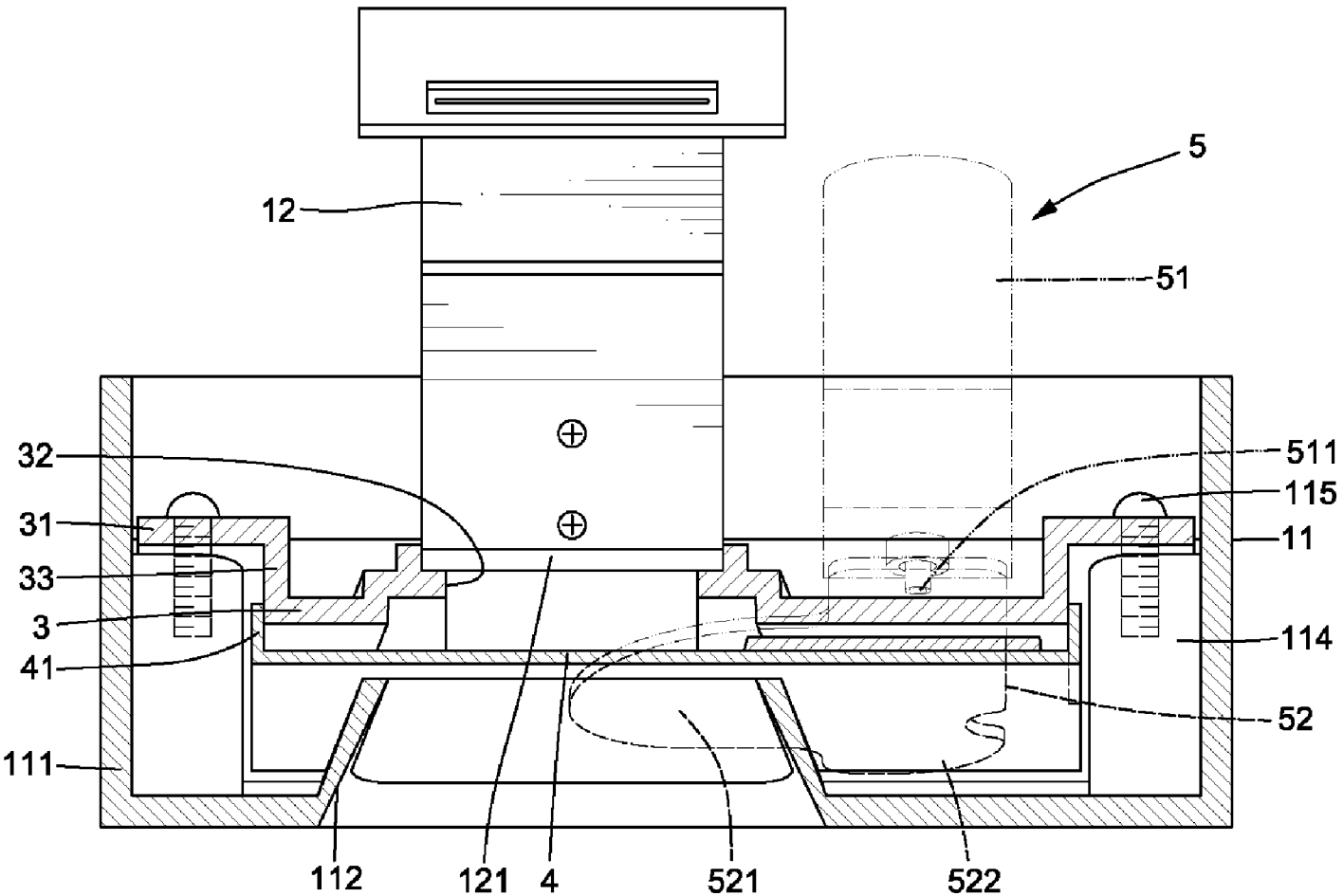
FIG. 5 is a sectional view taken along plane 5-5 in FIG. 1.

With reference to FIGS. 3 and 4, the protective device in accordance with the present invention is mounted in the casing 11 and includes a fixing plate 3, a protective cover 4, a drive mechanism 5, and a keypad 6. The fixing plate 3 is mounted in the casing 11 and located behind the opening 112 of the casing 11. In the embodiment shown, mounting posts 114 are provided on an inner face of the receiving portion 111 of the casing 11, and screws 115 are extended through holes (not labeled) in the fixing plate 3 into screw holes (not labeled) in the mounting posts 114 to fix the fixing plate 3 to the casing 11 (see FIG. 5). The fixing plate 3 includes a through-hole 32 aligned with and between the opening 112 of the casing 112 ad 111 and the fingerprint identifying device 12. A guide rail 33 is provided on each of two lateral sides 31 of the fixing plate 3. In the embodiment shown, the guide rails 33 are formed by two bends respectively on the lateral sides 31 of the fixing plate 3.

The protective cover 4 is mounted between the fixing plate 3, and the receiving portion 111 of the casing 11. In the embodiment shown, the protective cover 4 is a metal plate pressed to form two wings 41 respectively on two lateral sides thereof and upper and lower protrusions 42 and 43. The wings 41 of the protective cover 4 respectively and slidably engage with the guide rails 33 of the fixing plate 3, allowing the protective cover 4 to slide in a longitudinal direction of the fixing plate 3 between a shielding position in which the through-hole 32 of the fixing plate 3 and the opening 112 of the casing 11 are shielded and an open position in which the through-hole 32 and the opening 112 are revealed.

The drive mechanism 5 includes a motor 51 and a drive plate 52. In the embodiment shown, the motor 51 is mounted to an inner side of the fixing plate 3, with an output shaft 511 of the motor 51 extending to an outer side of the fixing plate 3 and engaged with the drive plate 52 such that the drive plate 52 is turned when the motor 51 turns. In the embodiment shown, the drive plate 52 includes first and second drive portions 521 and 522 respectively on upper and lower ends of the drive plate 52. When the motor 51 turns, one of the first and second drive portions 521 and 522 is driven to thereby move the protective cover 4 from one position to the other.

The keypad 6 is mounted to an outer side of the casing 11 and includes a plurality of press buttons 61 through which the authorized user can input a pin code for activating the motor 51 to turn for the purposes of driving the protective cover 4. Detailed structure of the keypad 6 is not described, for it is conventional.

Figure 6:
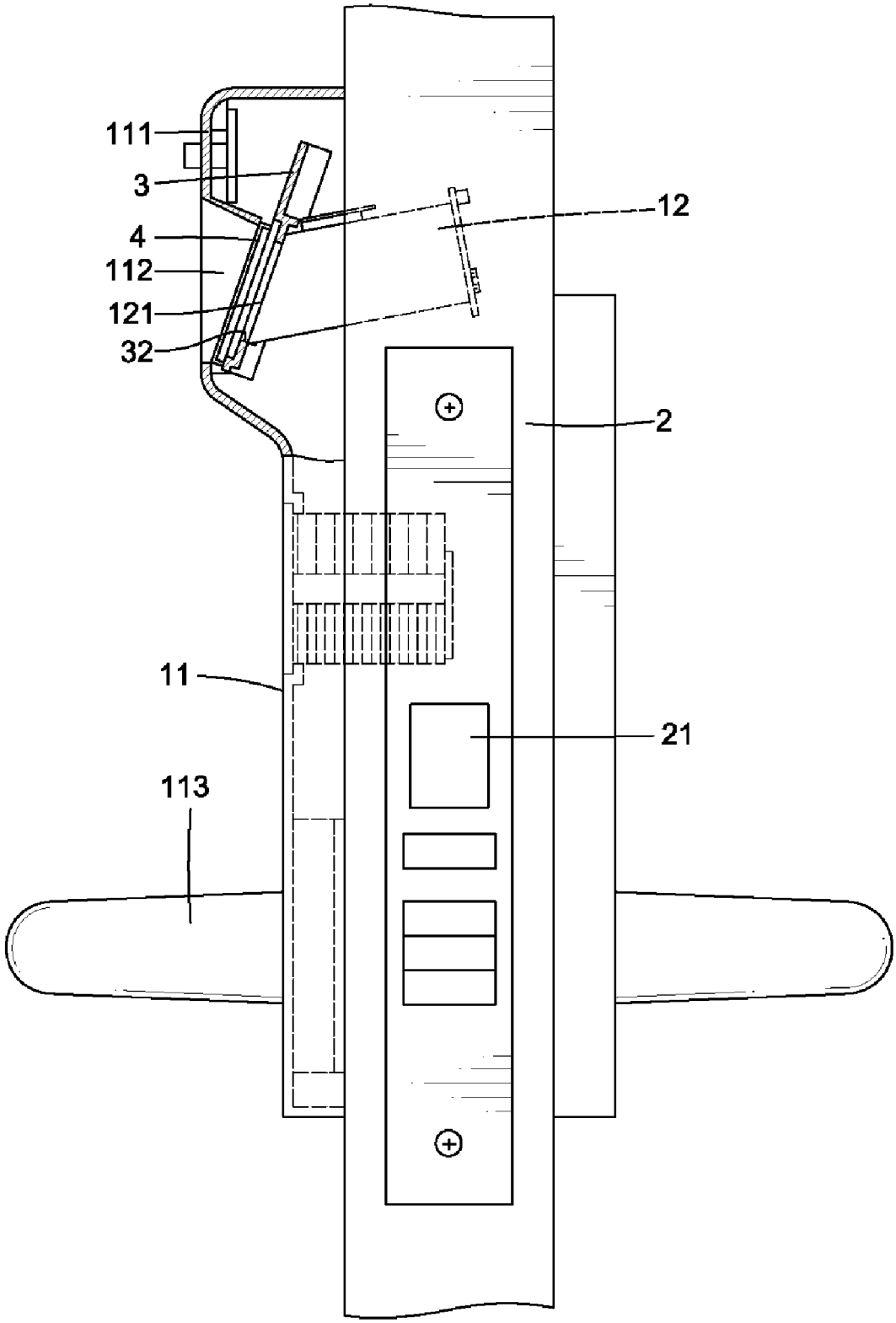
FIG. 6 is a sectional view taken along plane 6-6 in FIG. 1.
Figure 7:
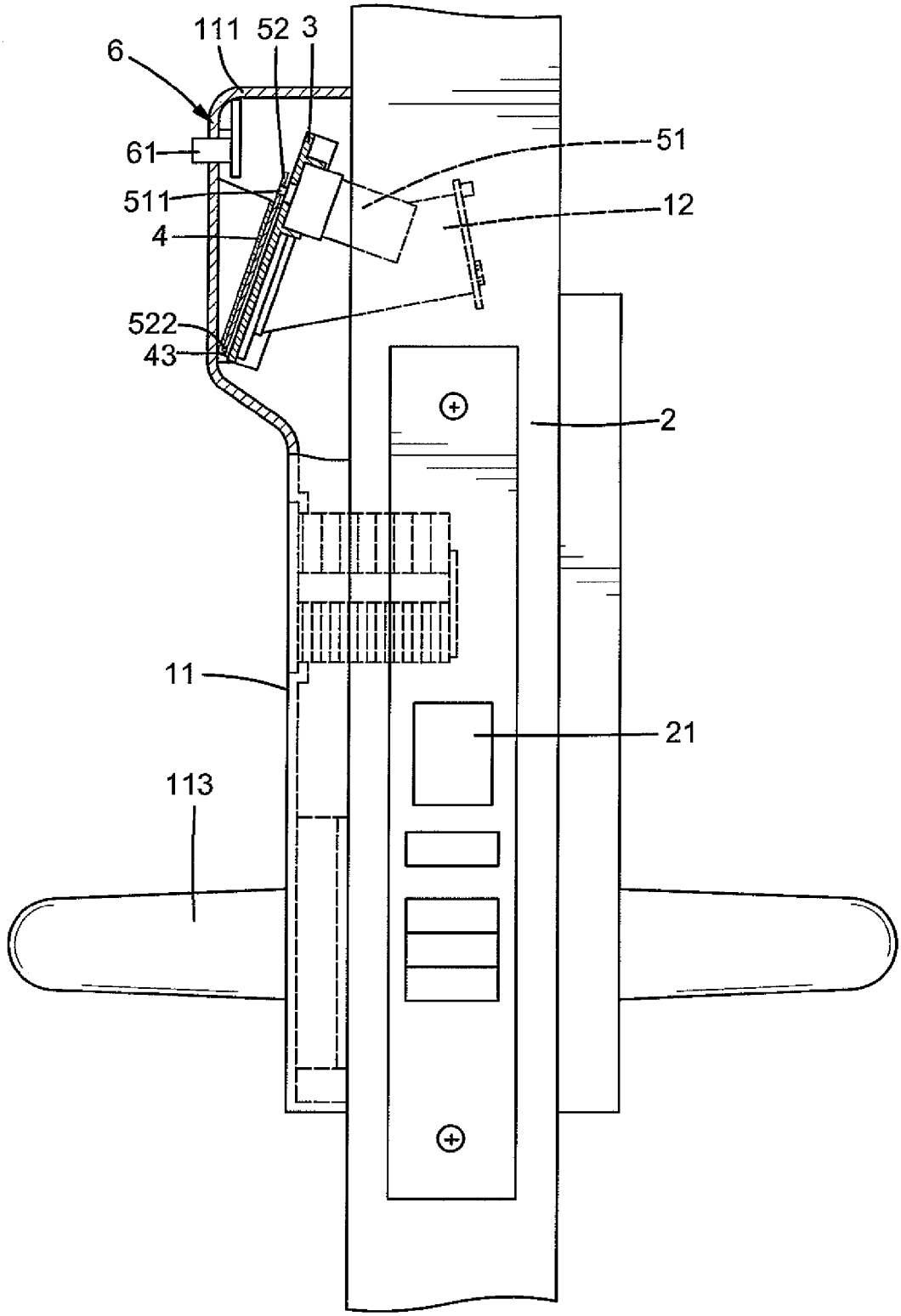
FIG. 7 is a sectional view taken along plane 7-7 in FIG. 1.

The elements in the electronic lock 1 are protected by the protective device in accordance with the present invention. With reference to FIGS. 6 and 7, the protective cover 4 is normally in the shielding position to shield the through-hole 32 of the fixing plate 3 and the opening 112 of the casing 11. Thus, dust and moisture cannot enter the interior of the electronic lock 1, avoiding damage to the electronic lock 1. Furthermore, a burglar or unauthorized user cannot destroy the fingerprint identifying device 12 of the electronic lock 1 through the opening 112 of the casing 11.

Figure 8:
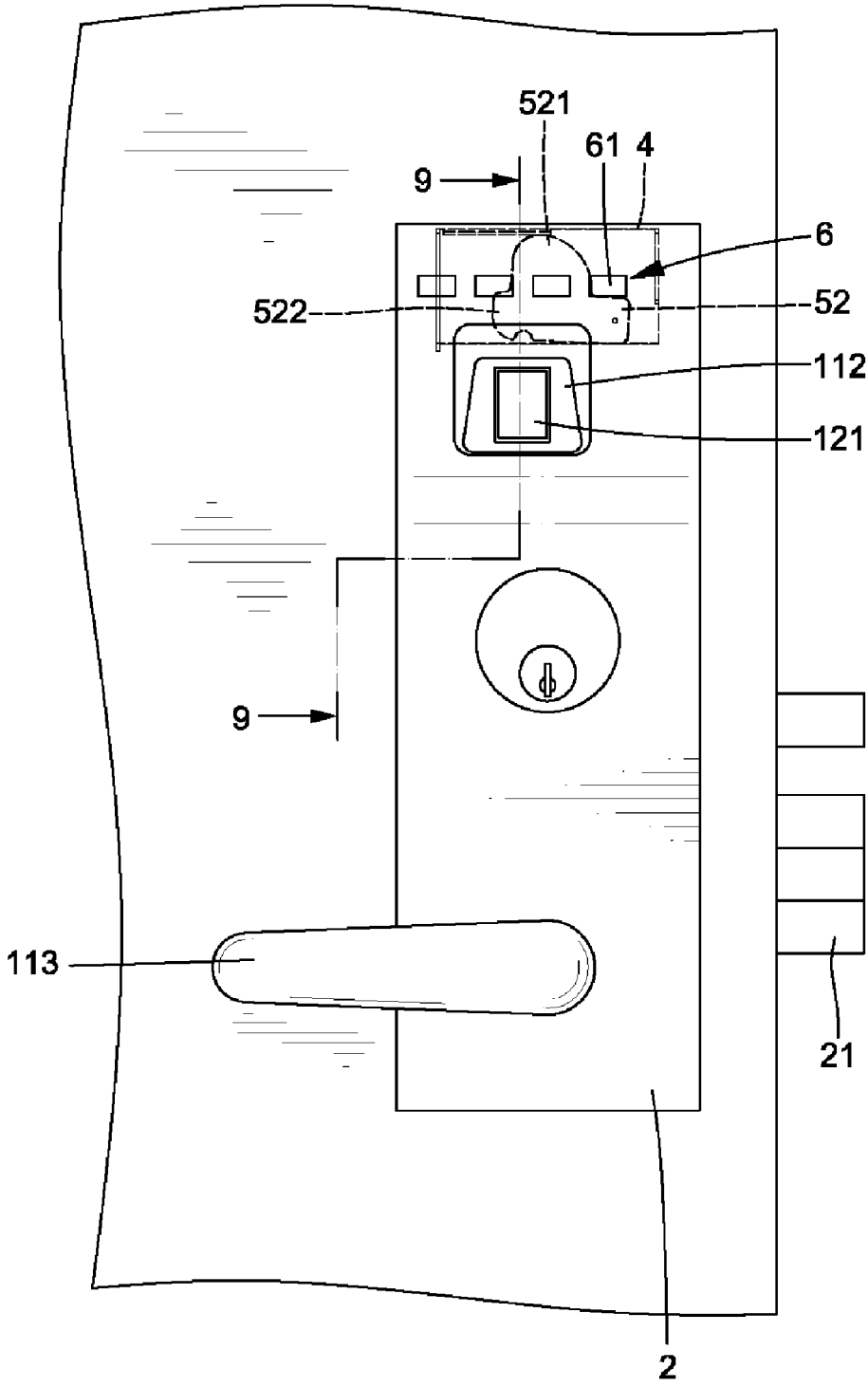
FIG. 8 is a view similar to FIG. 1, wherein the protective cover is in a revealing position.
Figure 9:
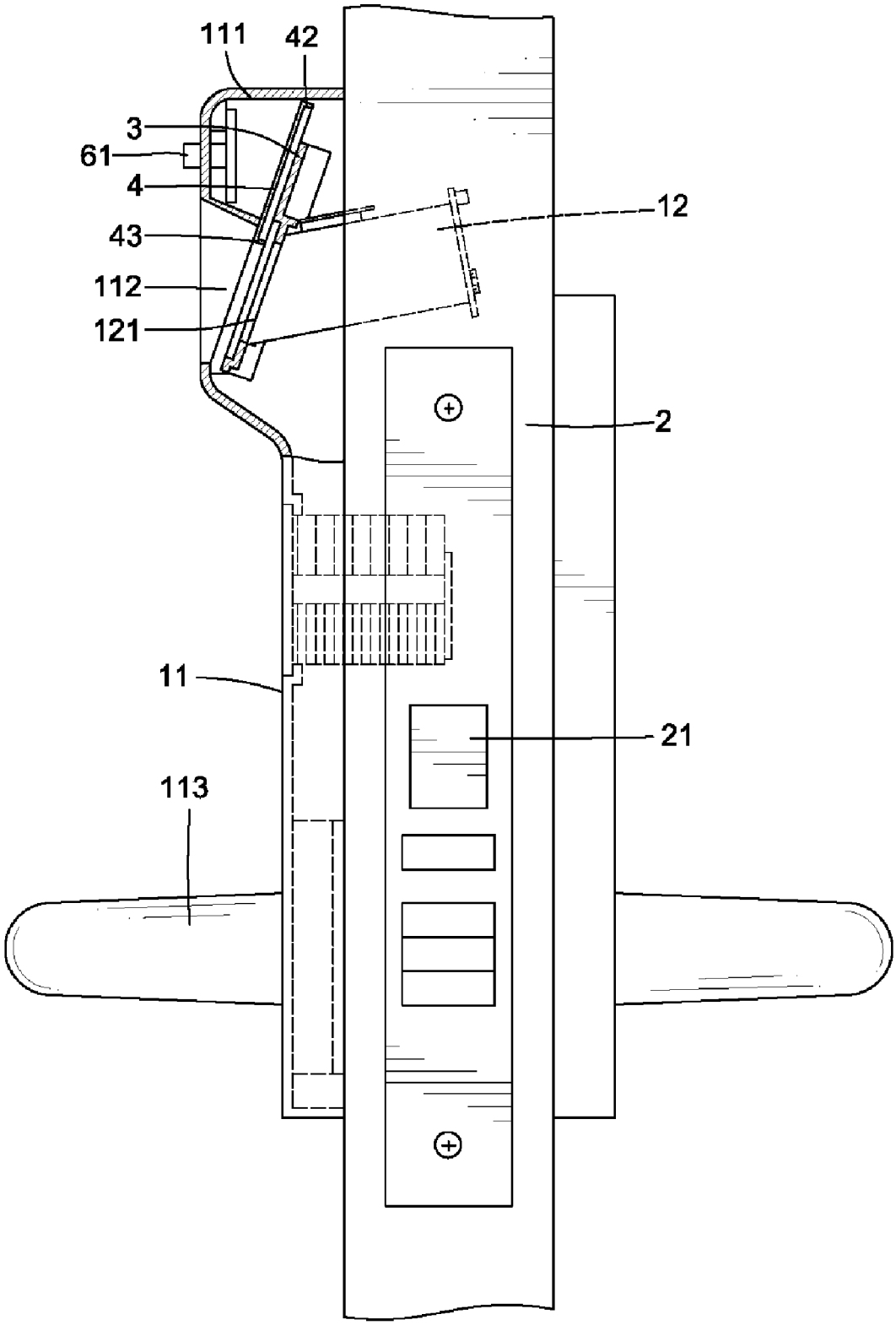
FIG. 9 is a sectional view taken along plane 9-9 in FIG. 8.
Figure 10:
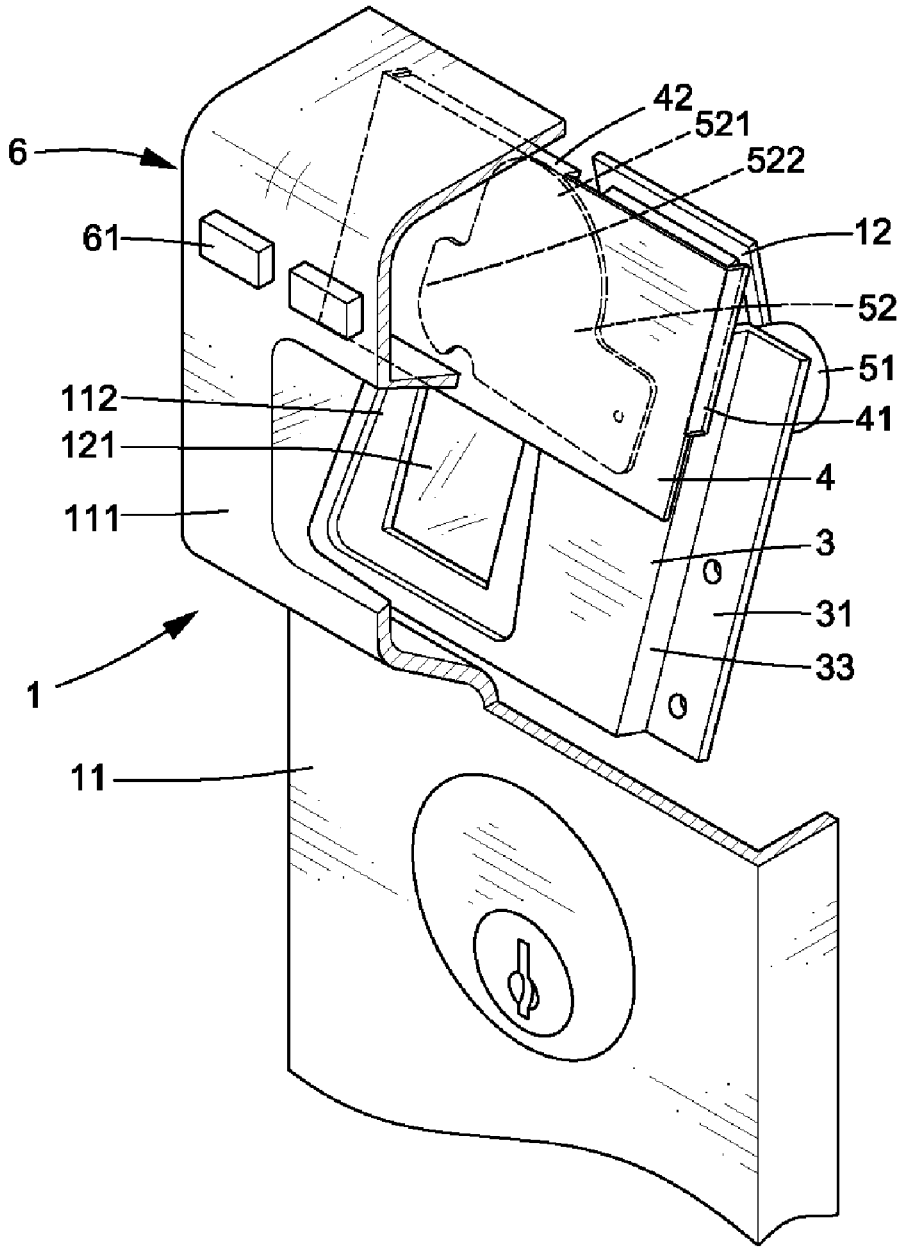
FIG. 10 is a view similar to FIG. 4, wherein the protective cover is in a revealing position.

In a case that an authorized user is intended to open the door, the authorized user inputs the pin code through the press buttons 61 of the keypad 6 to activate the motor 51. In a preferred form, the output shaft 511 of the motor 51 turns 90 degrees in a clockwise direction. The first drive portion 521 of the drive plate 52 pushes the upper protrusion 42 of the protective cover 4 and, thus, pushes the protective cover 4 away from the opening 112 of the casing 11 (see FIGS. 8 through 10) to the revealing position. Thus, the authorized user can insert his or her finger through the opening 112 of the casing 11 and the through-hole 32 of the fixing plate 3 to access the fingerprint identifying device 12. Thus, the handle 113 can be turned to open the door after identification of the fingerprint.

After a preset period of time or upon a preset movement, the output shaft 511 of the motor 51 turns 90 degrees in a counterclockwise direction such that the second drive portion 522 pushes the lower protrusion 43 of the protective cover 4 and, thus, pushes the protective cover 4 from the revealing position back to the shielding position. The opening 112 of the casing 11 and the through-hole 32 of the fixing plate 3 are shielded by the protective cover 4 again. It is noted that the second drive portion 522 of the drive plate 52 abuts against the lower protrusion 43 of the protective cover 4 such that the protective cover 4 cannot be opened when the protective cover 4 is in the shielding position, for passing through the output shaft 511 and the second drive portion 522 is perpendicular to the lower protrusion 43 of the protective cover 4 when the protective cover 4 is in the shielding position (see FIGS. 1, 4, and 7).

Conclusively, the elements inside the electronic lock 1 are protected by the protective cover 4. Use of the keypad 6 does not need keys. A useful and reliable electronic lock 1 is, thus, provided.

Although a specific embodiment has been illustrated and described, numerous modifications and variations are still possible without departing from the teachings of the invention. The scope of the invention is limited by the accompanying claims.

What is claimed is:

1. A protective device for an electronic lock, comprising:

a fixing plate adapted to be mounted in a casing of the electronic lock and located behind an opening of the casing, the fixing plate including a through-hole aligned with the opening;

a protective cover mounted to the fixing plate and movable between a shielding position shielding the through-hole of the fixing plate and the opening of the casing and a revealing position not shielding the through-hole of the fixing plate and the opening of the casing, with the protective cover including upper and lower protrusions;

a drive mechanism including a drive plate and a motor having an output shaft for driving the drive plate to urge the protective cover to move between the shielding position and the revealing position, with the drive plate having an upper, first drive portion and a lower, second drive portion, with the upper protrusion of the protective cover being pushable by the upper, first drive portion of the drive plate to move the protective cover from the shielding position to the revealing position, and with the lower protrusion being pushable by the lower, second drive portion of the drive plate to move the protective cover from the revealing position to the shielding position, with the lower, second drive portion being disengaged from the lower protrusion of the protective cover when the protective cover is in the revealing position, with a line passing through the output shaft and the lower, second drive portion being perpendicular to the lower protrusion of the protective cover when the protective cover is in the shielding position, and with the second, lower drive portion abutting against a top of the lower protrusion of the protective cover when the protective cover is in the shielding position; and a keypad adapted to be mounted to an outer side of the casing;

with the motor being activated to drive the drive plate to move the protective cover from the shielding position to the revealing position when a pin code is inputted through the keypad.

2. The protective device for the electronic lock as claimed in claim 1, with the fixing plate further including two guide rails respectively on two lateral sides thereof, with the protective cover including two wings bent at a nonparallel angle to the protective cover, with the two wings and the protrusions being perpendicular to the protective cover and to each other, and with the two wings being respectively and slidably engaged with the two guide rails, allowing the protective cover to slide on the fixing plate in a longitudinal direction of the fixing plate between the shielding position and the revealing position.

3. The protective device for the electronic lock as claimed in claim 2, with the fixing plate including two bends on the two lateral sides thereof and forming the guide rails.

4. An electronic lock comprising:

a casing including an opening;

a fingerprint identifying device mounted in the casing and including a fingerprint input section accessible through the opening;

a fixing plate mounted in the casing and located behind the opening of the casing, the fixing plate including a through-hole aligned with the opening of the casing;

a protective cover mounted to the fixing plate and movable between a shielding position shielding the through-hole of the fixing plate and the opening of the casing and a revealing position not shielding the through-hole of the fixing plate and the opening of the casing, with the protective cover including upper and lower protrusions;

a drive mechanism including a drive plate and a motor having an output shaft for driving the drive plate to urge the protective cover to move between the shielding position and the revealing position, with the drive plate having an upper, first drive portion and a lower, second drive portion, with the upper protrusion of the protective cover being pushable by the upper, first drive portion of the drive plate to move the protective cover from the shielding position to the revealing position, and with the lower protrusion being pushable by the lower, second drive portion of the drive plate to move the protective cover from the revealing position to the shielding position, with the lower, second drive portion being disengaged from the lower protrusion of the protective cover when the protective cover is in the revealing position, with a line passing through the output shaft and the lower, second drive portion being perpendicular to the lower protrusion of the protective cover when the protective cover is in the shielding position, and with the second, lower drive portion abutting against a top of the lower protrusion of the protective cover when the protective cover is in the shielding position; and a keypad mounted to an outer side of the casing;

with the motor being activated to drive the drive plate to move the protective cover from the shielding position to the revealing position when a pin code is inputted through the keypad.

5. The electronic lock as claimed in claim 4, with the fixing plate further including two guide rails respectively on two lateral sides thereof, with the protective cover including two wings bent at a nonparallel angle to the protective cover, with the two wings and the protrusions being perpendicular to the protective cover and to each other, and with the two wines being respectively and slidably engaged with the two guide rails, allowing the protective cover to slide on the fixing plate in a longitudinal direction of the fixing plate between the shielding position and the revealing position.

6. A protective device for an electronic lock, comprising:

a fixing plate adapted to be mounted in a casing of the electronic lock and located behind an opening of the casing, the fixing plate including a through-hole aligned with the opening;

a protective cover mounted to the fixing plate and movable between a shielding position shielding the through-hole of the fixing plate and the opening of the casing and a revealing position not shielding the through-hole of the fixing plate and the opening of the casing, with the protective cover including upper and lower protrusions;

a drive mechanism including a drive plate and a motor having an output shaft for driving the drive plate to urge the protective cover to move between the shielding position and the revealing position, with the drive plate having an upper, first drive portion and a lower, second drive portion, with the upper protrusion of the protective cover being pushable by the upper, first drive portion of the drive plate to move the protective cover from the shielding position to the revealing position, and with the lower protrusion being pushable by the lower, second drive portion of the drive plate to move the protective cover from the revealing position to the shielding position, with the lower, second drive portion being intermediate the upper and lower protrusions when the protective cover is in the revealing position, with the upper, first drive portion being intermediate the upper and lower protrusions when the protective cover is in the shielding position; and a keypad adapted to be mounted to an outer side of the casing;

with the motor being activated to drive the drive plate to move the protective cover from the shielding position to the revealing position when a pin code is inputted through the keypad.

* * * * *